United States Patent [19]

Winkler

[11] Patent Number: 4,930,283

[45] Date of Patent: Jun. 5, 1990

[54] BRICK

[75] Inventor: Bernhard Winkler, Starnberg, Fed. Rep. of Germany

[73] Assignee: Steiner Silidur AG. Andelfingen, Andelfingen, Switzerland

[21] Appl. No.: 354,541

[22] Filed: May 19, 1989

[30] Foreign Application Priority Data

May 19, 1988 [CH] Switzerland ..... 1899/88

[51] Int. Cl.[5] ..... E04B 5/04

[52] U.S. Cl. ..... 52/611; 47/83; 405/284; 405/272; 52/DIG. 2

[58] Field of Search ..... 52/611, DIG. 2; 47/83; 405/284, 285, 286

[56] References Cited

U.S. PATENT DOCUMENTS

| | | | |
|---|---|---|---|
| 4,379,651 | 4/1983 | Steiner | 405/284 |
| 4,426,176 | 1/1984 | Terada | 405/285 |
| 4,684,294 | 8/1987 | O'Neill | 405/284 X |

FOREIGN PATENT DOCUMENTS

| | | | |
|---|---|---|---|
| 3317633 | 11/1984 | Fed. Rep. of Germany | 405/284 |

*Primary Examiner*—Carl D. Friedman
*Assistant Examiner*—Linda J. Hoffert
*Attorney, Agent, or Firm*—Lewis H. Eslinger; Jay H. Maioli

[57] ABSTRACT

A brick or construction element comprised of cement or synthetic sand and/or gravel of the kind for erecting high embankments or earthworks has a shield-type support with a flat front wall to which are connected lateral wing sections angled toward the rear. A tie bar extends rearwardly from the center of the shield-type support and bottom walls are located between the shield-type support and the tie bar. Boreholes are provided through the wing sections and through the free end of the tie bar, into which reinforcing bars are inserted to enable the bricks to be held together when stacking them in courses to form a retaining wall.

10 Claims, 2 Drawing Sheets

FIG. 1
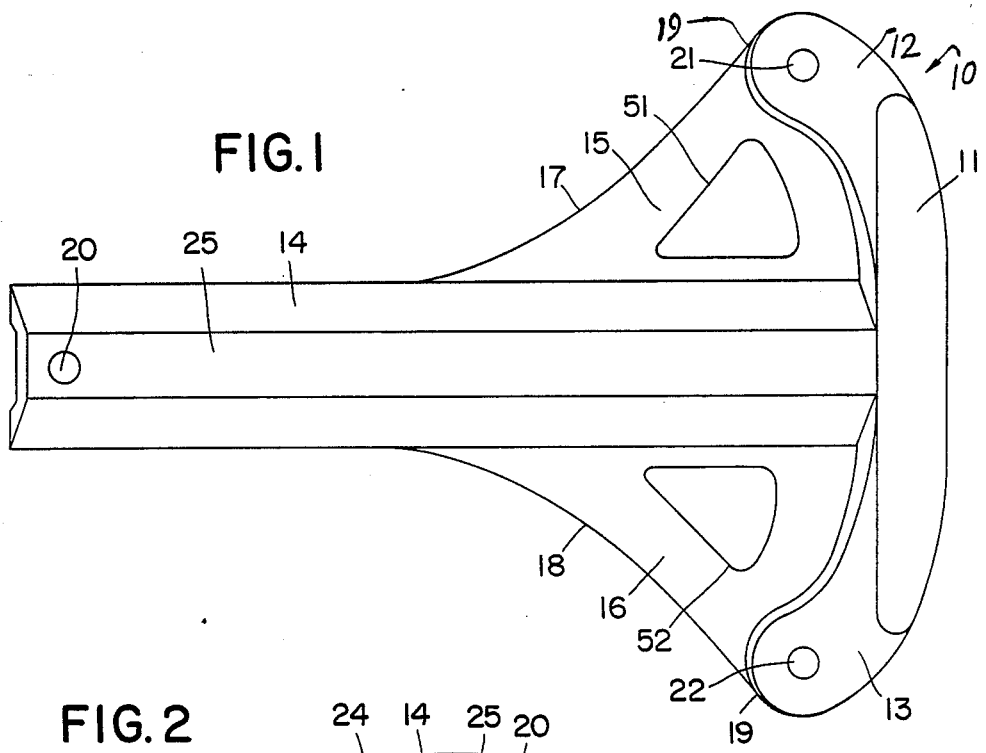
FIG. 2
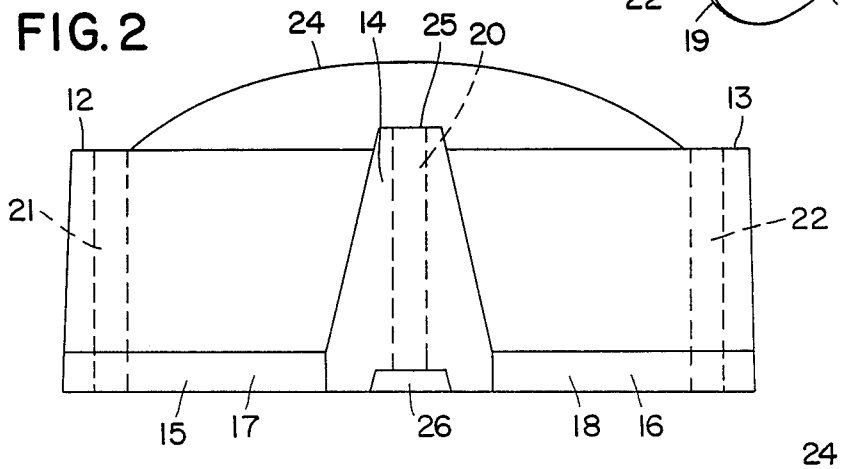
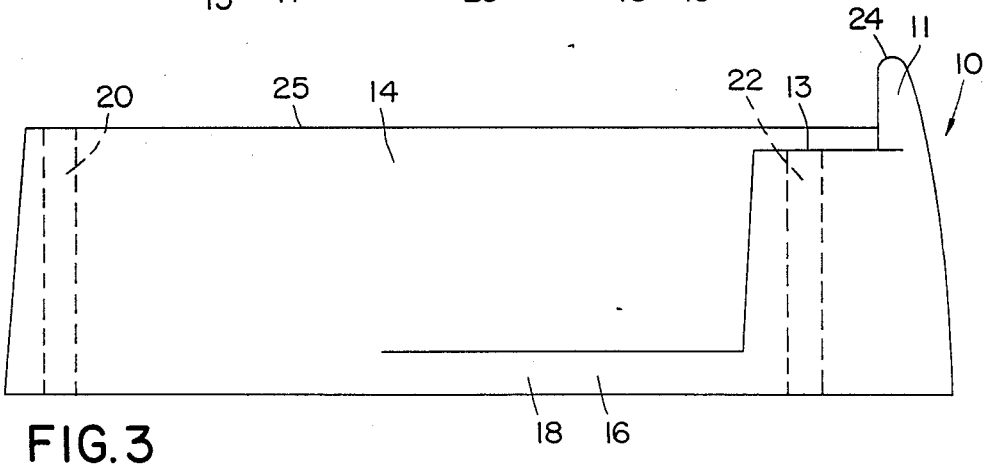
FIG. 3

BRICK

BACKGROUND OF THE INVENTION

1. Field of the Invention

This invention relates generally to a brick or construction element for erecting dry-construction retaining walls and, more particularly, to a brick comprised of cement or concrete or synthetic sand and/or gravel suitable for constructing a retaining wall.

2. Description of the Background

German Patent publication No. DE-A-25 37 408 describes a retaining wall brick for erecting dry walls that retain earth in such a way that shrubs may be planted in the retained earth. Such retaining wall brick is comprised of a shield-type support located at the bottom and two side walls, with the support being visible in the resultant retaining wall. The upper face has a convex curvature and the rest of the shield-type support has a flat front. The curvature of the upper face extends downwardly across the side face, while the faces of the side walls together with the curvature extend toward the rear. At the underside of the bottom are two grooves that run parallel to the side walls, and the inner surface of the bottom wall is continuous and forms the rear section of a cross rib.

Brick of the kind described above can be used for erecting walls that are several feet in height, because on the one hand the shield-type supports extend vertically beyond the side walls, thereby preventing forward displacement, and on the other hand the bottom walls with the grooves are located at the side walls, thereby preventing lateral displacement. The continuous bottom area collects any water that accumulates between shield-type support, side walls, and cross rib, so that even during hot, dry summer periods the soil will not dry out, and the plants can develop instead of wilting.

The disadvantages encountered with this type of retaining wall brick are that it is suitable for enforcing and securing embankments of up to a height of only about 26 feet and such bricks are then unsuitable both for higher embankments, as are nowadays required in low lying cut-throughs, and in the formation of earthworks.

OBJECTS AND SUMMARY OF THE INVENTION

Accordingly, it is an object of the present invention to provide a retaining wall brick that can eliminate the above-noted defects inherent in the prior art.

It is another object of this invention to provide retaining wall brick suitable for erecting higher embankments and/or earthworks than heretofore possible with known bricks.

In accordance with an aspect of the present invention, a retaining wall brick is comprised of cement or concrete or a synthetic sand and/or gravel and is formed with a single, straight, rearwardly directed tie bar that extends from the center of the shield-like support and that has both a hole formed in the end thereof and an upper narrow ridge to stabilize lateral movement of the bricks after dry construction into a retaining wall. The resultant retaining wall is particularly suited for permitting shrubs to be planted in the retained earth.

The above and other objects, features, and advantages of the present invention will become apparent from the following detailed description of illustrative embodiments to be read in conjunction with the accompanying drawings.

BRIEF DESCRIPTION OF THE DRAWINGS

FIG. 1 is plan view of a retaining wall brick according of the invention;

FIG. 2 is a rear elevational view of the retaining wall brick of FIG. 1;

FIG. 3 is a side elevational view of the retaining wall brick of FIG. 1;

DETAILED DESCRIPTION OF PREFERRED EMBODIMENTS

Figure 4:
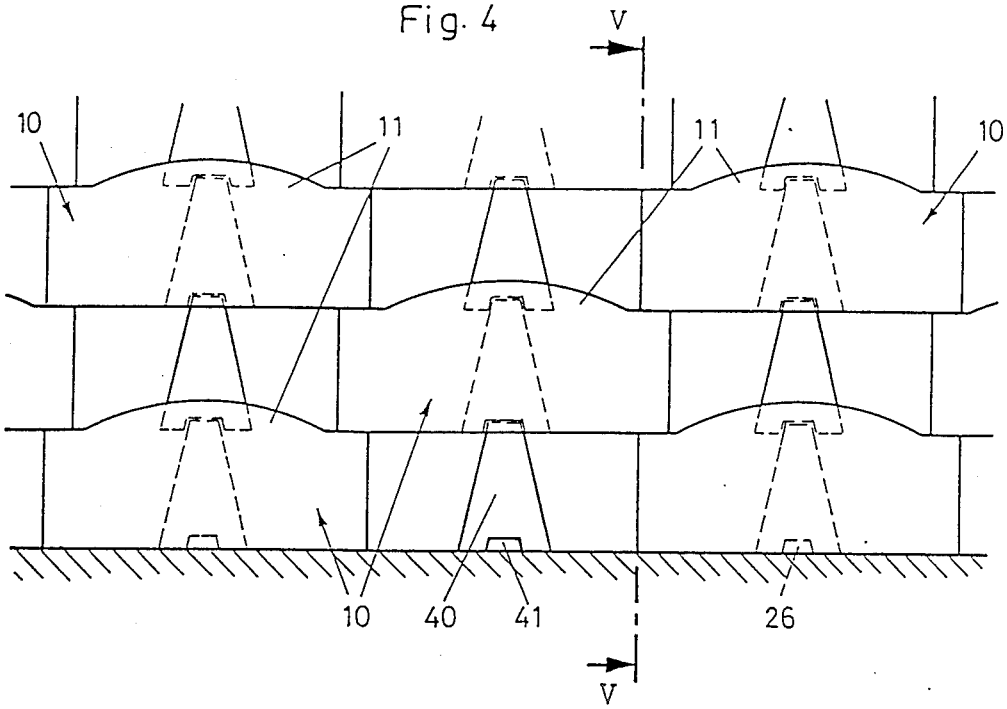
FIG. 4 is an elevational view of a retaining wall comprised of bricks such as shown in FIG. 1, in which the retaining wall is further provided with support wedges and extension elements.

The brick as shown in FIGS. 1, 2, and 3 is formed having a shield-type support element, shown generally at 10, a flat center section 11, and two lateral wing or side sections 12, 13 angularly extending on either side from the center section toward the rear of the brick. A tie bar 14 is formed as a single, unitary element at a right angles to flat center section 11 and extending rearwardly. Bottom walls 15, 16 are formed, respectively, as webs between the lateral wing sections 12, 13 of shield-type support 10 and both sides of tie bar 14. Bottom walls 15, 16 each have concave shaped outwardly facing sides 17, 18 which, starting at the outside edge 19 of wing sections 12, 13, each blend into respective side faces of tie bar 14.

At its free end section, opposite flat center section 11, tie bar 14 is provided with a continuous borehole 20 that is parallel to flat center section 11 of shield-type support 10 and that extends through tie bar 14.

Additional boreholes 21, 22 are also located in respective wing sections 12, 13. In this embodiment, boreholes 21, 22 in wing sections 12, 13 extend through respective bottom walls 15, 16, with each longitudinal axis being approximately parallel to the flat center section 11 of the shield-type support 10.

In the embodiment shown in FIGS. 1, 2, and 3 center section 11 of shield-type support 10 is provided with an upper convex face 24 whose top portion is positioned higher above the bottom areas 15, 16 than the upper face edges of the lateral wings 12, 13. As shown in FIG. 4, this permits the backfill to extend beyond the bottom area of a brick erected thereon.

According to one embodiment of such a brick described above, the shield-type support 10 is 61.023 inches wide and 20.275 inches high, and the length of the shield-type support 10 and tie bar 14 together measure 61.810 inches. It will be appreciated that such a brick has a considerable weight.

Figure 5:
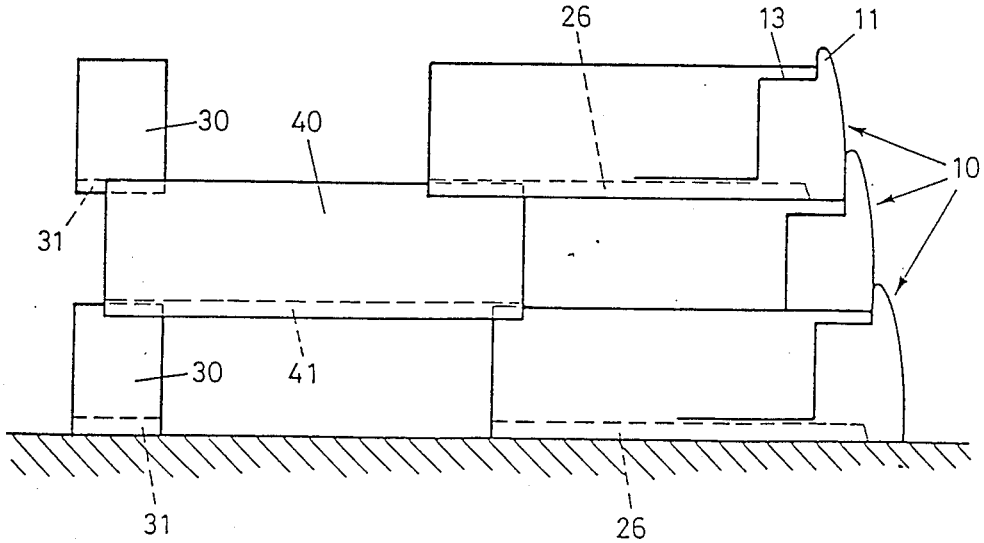
FIG. 5 shows a cross-sectional view of the retaining wall taken along section lines 5—5 in FIG. 4.

As shown in FIG. 5, due to recessing by the thickness of the shield-type support 10, which measures about 4.527 inches, the foundation must be widened by load bearing wedges 30 and extension elements 40, so that the top-most bricks of the retaining wall will rest on a suitable load-bearing foundation.

Bearing wedges 30 and extension elements 40 have the same general cross-sectional configuration as tie bar 14, that is, they are wedge-shaped, having an increase in width toward the bottom. Longitudinal grooves 26, 31, 41, which have the same width as the top 25 of tie bar 14 are formed in the bottom of tie bar 14, bearing wedge 30, and extension element 40, respectively. The continuous vertical borehole 20 in the end region of tie bar 14, and similar boreholes (not shown) in the two end regions of extension element 40 and bearing wedge 30 permit a mutual attachment by means of reinforcing bars or similar devices during construction, so as to prevent displacement of the backfill.

FIGS. 4 and 5 illustrate a retaining wall that can be constructed using the inventive bricks described above. The design of the shield-type support avoids long, horizontal straight lines, which might be annoying in larger constructions. Another possibility for avoiding the distinctive and unnatural characteristic of straight lines would be to provide the shield with chamfered grooves, so as to produce a quarry stone wall image.

In addition to the elements of the brick described above it may also be desirable to add openings 51, 52 in respective bottom walls 15, 16 in the vicinity of shield-type support 11 on both sides of tie bar 14. On the one hand, this saves material and reduces the wall's weight and, on the other hand, it drains the ground above the openings.

The above description is given on a single preferred embodiment of the invention, but it will be apparent that many modifications and variations could be effected by one skilled in the art without departing from the spirit or scope of the novel concepts of the invention, which should be determined by the appended claims.

What is claimed is:

1. A brick consisting of cement or synthetic sand or gravel for use in combination with other like bricks for erecting dry construction, earth retaining walls, each said brick comprising: a straight tie bar attached as a single, unitary element at the center of a shield-type support having a convex face and at right angles to at least a center section of said shield-type support; side wing sections formed at sides of said shield-type support and having a height so as to be below the shield-type support; and attachment means formed in said tie bar for cooperating with said attachment means formed in said other like bricks.

2. A brick as defined in claim 1, further comprising a bottom wall connected to said shield-type support extending over part of the length of said tie bar.

3. A brick as defined in claim 2, wherein outside edges of each of said side wing sections include a borehole arranged substantially perpendicularly to said bottom wall.

4. A brick as defined in claim 2, wherein a width of said bottom wall becomes narrower as the distance from said shield-type support along said tie bar increases.

5. A brick as defined in claim 4, wherein the width of said wall diminishes in accordance with a convex line.

6. A brick as defined in claim 2, wherein said bottom wall proximate said shield-type support is provided on both sides of said tie bar and a through opening is formed in said bottom wall on said both sides of said tie bar.

7. A brick as defined in claim 2, wherein said attachment means comprises a borehole formed in an end of said tie bar opposite said shield-type support.

8. A brick as defined in claim 1, wherein a cross section of said tie bar is substantially an equilateral trapezoid.

9. A brick as defined in claim 8, wherein the cross section is a wedge shape broadening by degrees.

10. A brick as defined in claim 9 wherein said tie bar includes in an underside thereof a longitudinal groove whose width corresponds to that of the tie bar at an upper edge.

* * * * *